US008839577B1

(12) United States Patent
Wildeman

(10) Patent No.: US 8,839,577 B1
(45) Date of Patent: Sep. 23, 2014

(54) SKYLIGHT WINDOW DORMER

(71) Applicant: Roy C. Wildeman, North Captiva, FL (US)

(72) Inventor: Roy C. Wildeman, North Captiva, FL (US)

( * ) Notice: Subject to any disclaimer, the term of this patent is extended or adjusted under 35 U.S.C. 154(b) by 0 days.

(21) Appl. No.: 14/251,798

(22) Filed: Apr. 14, 2014

Related U.S. Application Data

(60) Provisional application No. 61/812,044, filed on Apr. 15, 2013.

(51) Int. Cl.
*E04B 7/18* (2006.01)
*E04D 13/03* (2006.01)

(52) U.S. Cl.
CPC ..... *E04D 13/032* (2013.01)
USPC ..... 52/200; 52/460; 52/461

(58) Field of Classification Search
USPC ..... 52/200, 203, 204.53, 204.57, 204.58, 52/204.593, 204.595, 90.2
See application file for complete search history.

(56) References Cited

U.S. PATENT DOCUMENTS

| | | | | |
|---|---|---|---|---|
| 1,840,041 | A * | 1/1932 | Kellogg | 52/200 |
| 3,844,087 | A | 10/1974 | Schultz et al. | |
| 3,983,669 | A * | 10/1976 | Bogaert | 52/200 |
| 4,114,330 | A * | 9/1978 | Sukolics | 52/200 |
| 4,539,783 | A * | 9/1985 | O'Keeffe et al. | 52/200 |
| 4,548,006 | A | 10/1985 | Roberts, Sr. | |
| 4,577,619 | A | 3/1986 | Howe, Jr. | |
| 4,665,964 | A | 5/1987 | Zommers | |
| 4,672,774 | A | 6/1987 | Rasmussen | |
| 4,823,525 | A | 4/1989 | Roberts et al. | |
| 4,917,167 | A | 4/1990 | Voss et al. | |
| 5,094,040 | A | 3/1992 | Bunka | |
| D336,527 | S | 6/1993 | Cole | |
| 5,408,795 | A * | 4/1995 | Eljadi et al. | 52/173.3 |
| 5,467,564 | A * | 11/1995 | DeKeyser et al. | 52/173.3 |
| 5,596,848 | A | 1/1997 | Lynch | |
| 5,913,785 | A | 6/1999 | Moller et al. | |
| 6,105,324 | A * | 8/2000 | Krusec et al. | 52/302.1 |
| D432,667 | S | 10/2000 | Moller | |
| 6,138,738 | A | 10/2000 | Moller et al. | |
| 6,415,570 | B1 * | 7/2002 | Wentz | 52/302.1 |
| D582,054 | S | 12/2008 | Moller et al. | |
| D582,055 | S | 12/2008 | Moller et al. | |
| D617,007 | S | 6/2010 | Kjaergaard et al. | |
| D617,008 | S | 6/2010 | Kjaergaard et al. | |
| 2004/0103597 | A1 * | 6/2004 | Ellenberger | 52/90.2 |
| 2010/0018138 | A1 * | 1/2010 | Lundsgaard et al. | 52/200 |
| 2011/0029290 | A1 * | 2/2011 | Onchuck | 703/1 |
| 2012/0167496 | A1 * | 7/2012 | Lindgren et al. | 52/204.1 |
| 2013/0192145 | A1 * | 8/2013 | Hoch | 52/58 |

FOREIGN PATENT DOCUMENTS

| | | |
|---|---|---|
| EP | 0702769 | 1/1998 |

* cited by examiner

*Primary Examiner* — William Gilbert
*Assistant Examiner* — Beth Stephan
(74) *Attorney, Agent, or Firm* — The Livingston Firm; Edward M. Livingston, Esq.; Bryan L. Loeffler, Esq.

(57) ABSTRACT

A skylight window dormer for installation on a pitched roof or sloped surface. The skylight window dormer is constructed form a plurality of triangular shaped or elliptically curved panels joined to form a dormer type structure that provides panoramic viewing and additional headroom in tightly enclosed interior spaces. The skylight window dormer is installed using a similar method as conventional skylights and is, thus, combining the efficiency of installing a conventional skylight with the benefits of additional space provided by a conventional dormer.

20 Claims, 10 Drawing Sheets

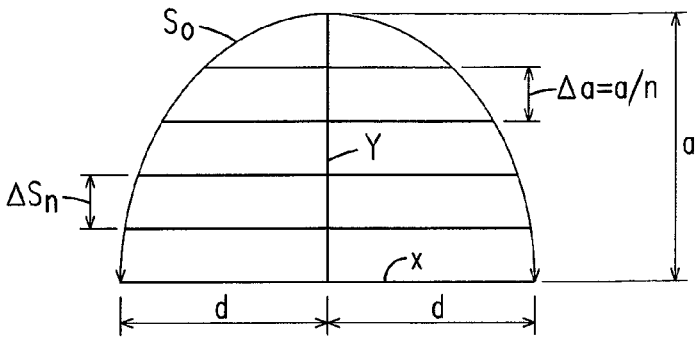
FIG. 23
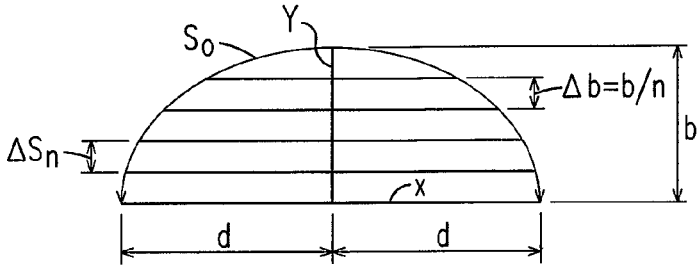
FIG. 24
FIG. 25
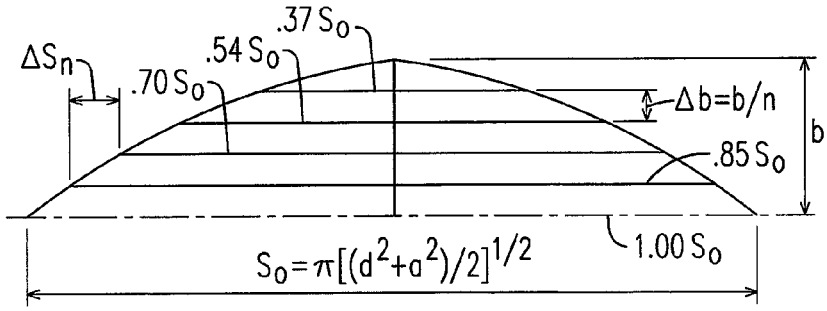
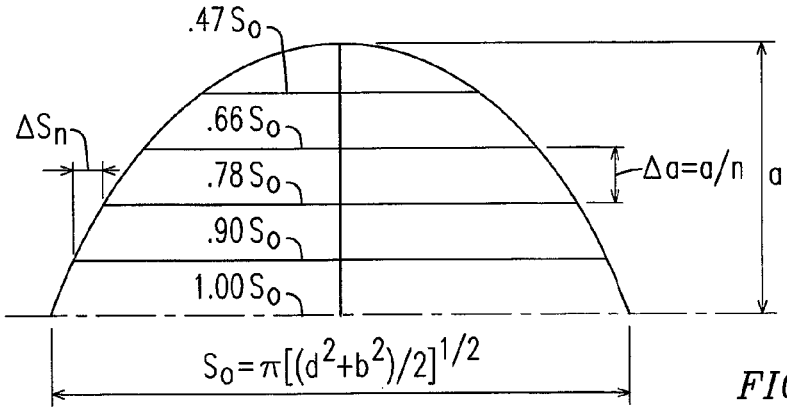
FIG. 26

SKYLIGHT WINDOW DORMER

CROSS-REFERENCE TO RELATED APPLICATIONS

This application claims priority to application No. 61/812,044 filed on Apr. 15, 2013, which is currently pending. The patent application identified above is incorporated herein by reference in its entirety to provide continuity of disclosure.

FIELD OF THE INVENTION

This application relates to a skylight window having a substantially trapezoidal or ellipsoid shape to form a dormer when installed on a conventional pitched roof.

BACKGROUND OF THE INVENTION

Skylight windows are widely used in day lighting design in residential and commercial buildings to provide natural light through a roof of a structure. Conventional skylights normally have a perimeter frame that is rectangular with one or more pane of glass mounted within the frame and lay parallel to a pitched roof. Such conventional skylights have a drawback in that the collection of light is limited by the placement of the sky light on a side or exposure of a pitched roof in relation to the placement of the sun during the day. In addition, conventional flat skylights do not provide additional space in attic rooms wherein the ceiling is also the roof. Regarding dormers, conventional dormers do provide additional space in attic rooms. However, conventional dormers are even more limited with the collection of natural light in relation to the position of the sun and the side of a structure on which the conventional dormer is located on.

Therefore, a need exists for a skylight window having a plurality of translucent or transparent panels configured to create a trapezoidal shape in relation to a pitched roof, thereby creating a skylight window that is capable of collecting a greater amount of natural light than a conventional skylight while also providing addition space like a conventional dormer.

The relevant prior art includes the following references:

| Pat. No. | Inventor | Issue/Publication Date |
|---|---|---|
| | (U.S. Patent References) | |
| 3,844,087 | Schultz et al. | Oct. 29, 1974 |
| 4,114,331 | Sukolics | Sep. 19, 1978 |
| 4,548,006 | Roberts, Sr. | Oct. 22, 1985 |
| 4,577,619 | Howe, Jr. | Mar. 25, 1986 |
| 4,672,774 | Rasmussen | Jun. 16, 1987 |
| 4,665,964 | Zommers | May 19, 1987 |
| 4,823,525 | Roberts et al. | Apr. 25, 1989 |
| 4,917,167 | Voss et al. | Apr. 17, 1990 |
| 5,094,040 | Bunka | Mar. 10, 1992 |
| D336,527 | Cole | Jun. 15, 1993 |
| 5,596,848 | Lynch | Jan. 28, 1997 |
| 5,913,785 | Moller et al. | Jun. 22, 1999 |
| D432,667 | Moller | Oct. 24, 2000 |
| 6,138,738 | Moller et al. | Oct. 31, 2000 |
| D582,054 | Moller et al. | Dec. 2, 2008 |
| D582,055 | Moller et al. | Dec. 2, 2008 |
| D617,007 | Kjaergaard et al. | Jun. 1, 2010 |
| D617,008 | Kjaergaard et al. | Jun. 1, 2010 |
| | (Foreign Patent References) | |
| EP0702769 | Abraham et al. | Jan. 21, 1998 |

SUMMARY OF THE INVENTION

The primary object of the present invention is to provide a skylight window having a plurality of translucent or transparent panels configured to create a trapezoidal shape in relation to a pitched roof, thereby creating a skylight window that is capable of collecting a greater amount of natural light than a conventional skylight while also providing additional space of a conventional dormer.

An additional object of the present invention is to provide a skylight window having a plurality of translucent or transparent panels configured to create an elliptically curved shape in relation to a pitched roof, thereby creating a skylight window that is capable of collecting a greater amount of natural light than a conventional skylight while also providing additional space of a conventional dormer The present invention fulfills the above and other objects by providing a trapezoidal skylight window dormer having four transparent and/or translucent panels made of glass, plastic or equivalent material and configured into a pitched, trapezoidal skylight with an angled, trapezoidal window to form a dormer type structure which can be installed on a conventionally framed, pitched roof of a structure. A pitch of a roof on which the present invention is being installed is preferably greater than 6:12 and less than 12:12.

The four panels forming the trapezoidal skylight window dormer of the present invention are triangular shaped with two of the panels being upper panels having identical shapes and forming a roof or upper surface of the trapezoidal skylight window dormer and two lower front panels, also having identical shapes that are angled in relation to each other, forming window or front surface. The panels are assembled in a framework, made of rigid material, such as metal, wood and so forth, and sealed in the framework to provide structural integrity and weather tightness. A lower free edge of the skylight window dormer is secured to a base frame which in turn is fitted and secured to a host roof. The junction of the skylight window dormer base and host roof is preferably flashed to provide a weather tight seal and trim, such as a metal trim, installed over the flashing to complete the installation. The interior portion of the skylight window dormer and ceiling may then be finished with conventional materials, such as wood trim.

Alternatively, the present invention fulfills the above and other objects by providing an elliptically curved skylight window dormer of two transparent and/or translucent panels, constructed from glass, plastic and so forth, configured to integrate a pitched, elliptically curved skylight with an similarly curved window to form a dormer type structure which can be installed on a conventionally framed, pitched roof of a structure. A pitch of a roof on which the present invention is being installed is preferably greater than 6:12 and less than 12:12.

The two panels forming the elliptically curved skylight window dormer of the present invention are elliptically shaped with an upper panel, having an elliptical curved shaped, forming a roof or upper surface of the elliptically curved skylight window dormer and a front panel, also having an elliptical curved shaped, forming window or front surface. The panels are assembled in a framework, made of rigid material, such as metal, wood and so forth, and sealed in the framework to provide structural integrity and weather tightness. A lower free edge of the skylight window dormer is secured to a base frame which in turn is fitted and secured to a host roof. The junction of the skylight window dormer base and host roof is preferably flashed to provide a weather tight seal and trim, such as a metal trim, installed over the flashing to complete the installation. The interior portion of the skylight window dormer and ceiling may then be finished with conventional materials, such as wood trim.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which:

FIG. 23 is a cross section along lines A-A of FIG. 19;

FIG. 24 is a cross section along lines B-B of FIG. 19;

FIG. 25 is a front window plan for developing the present invention from a flat plastic sheet showing the angles required to create a monolithic three dimensional assembly from the flat plastic sheet material;

FIG. 26 is an upper window plan for developing the present invention from a flat plastic sheet showing the angles required to create a monolithic three dimensional assembly from the flat plastic sheet material;

DESCRIPTION OF THE PREFERRED EMBODIMENTS

Figure 1:
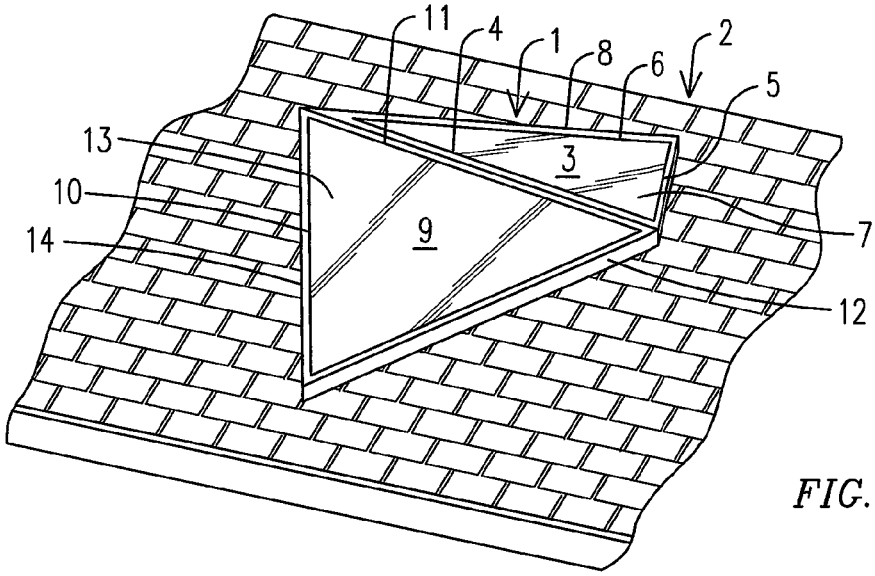
FIG. 1 is an angled skylight window dormer installed on a pitched host roof having an angled slope.
Figure 2:
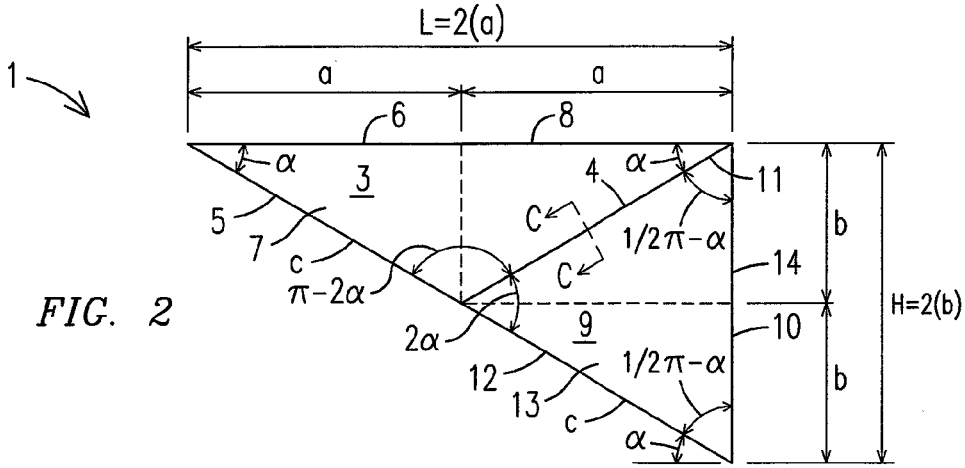
FIG. 2 is a side view of a skylight window dormer of the present invention.
Figure 3:
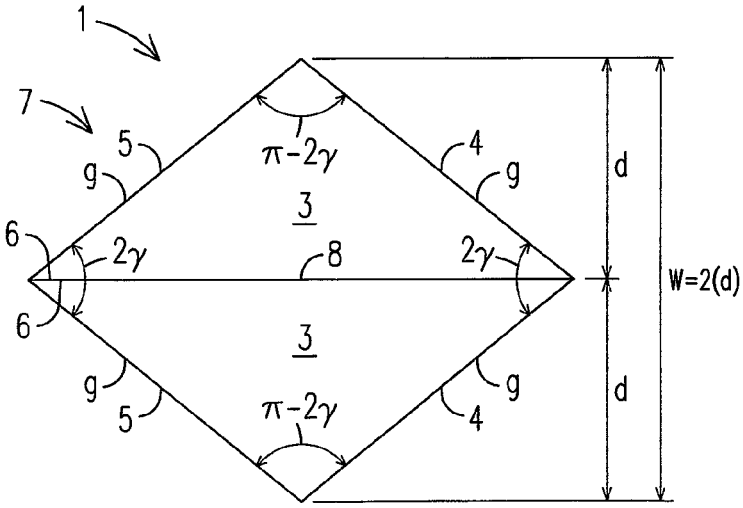
FIG. 3 is a top view of a skylight window dormer of the present invention.
Figure 4:
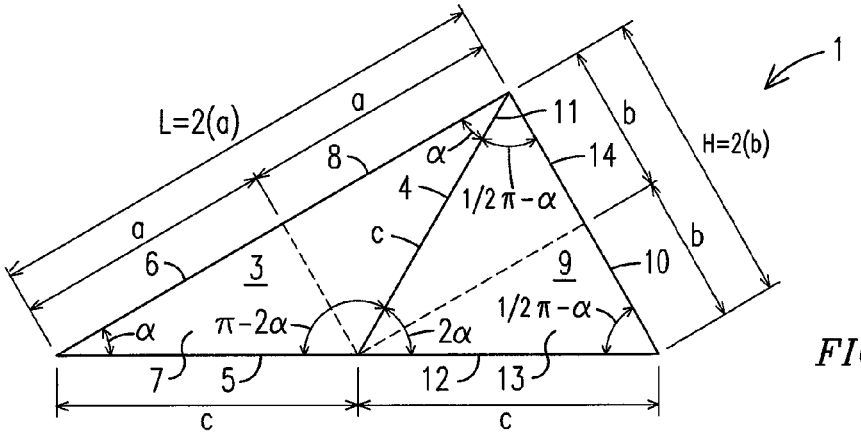
FIG. 4 is an opposing side view to FIG. 1 of a skylight window dormer of the present invention.
Figure 5:
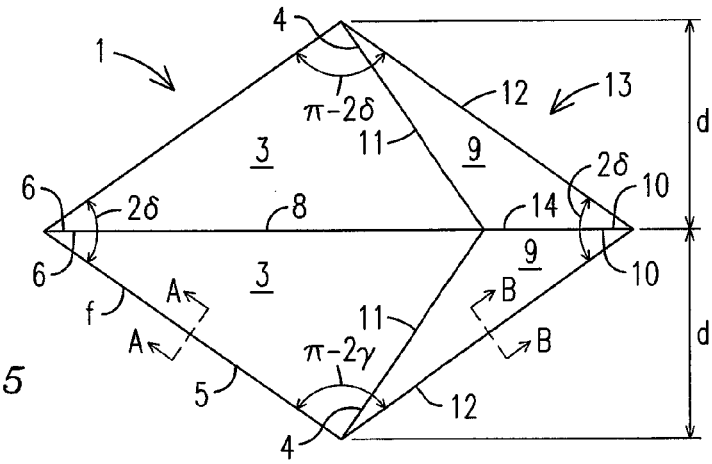
FIG. 5 is a perspective top view of a skylight window dormer of the present invention.
Figure 6:
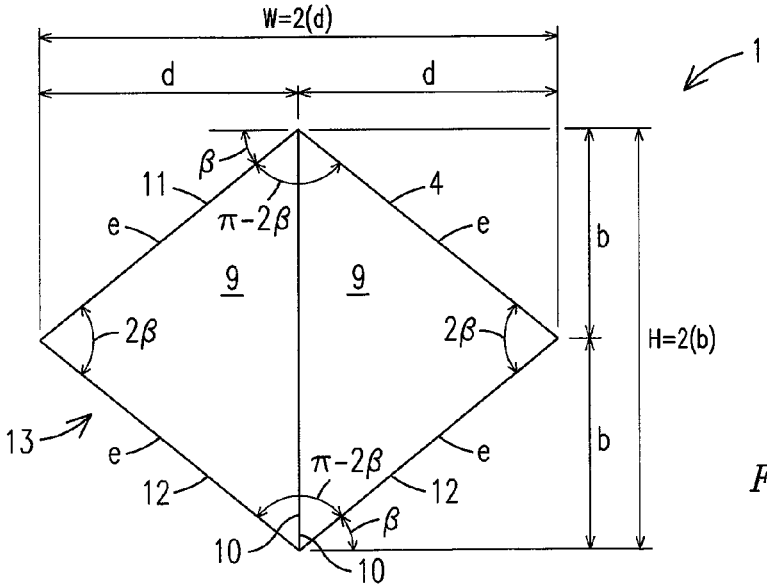
FIG. 6 is front view of a skylight window dormer of the present invention.
Figure 7:
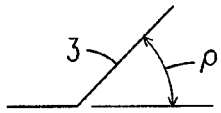
FIG. 7 is a cross section along lines A-A of FIG. 5.
Figure 8:
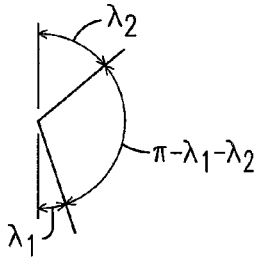
FIG. 8 is a cross section along lines C-C of FIG. 2.
Figure 9:
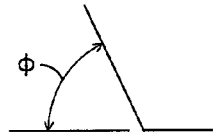
FIG. 9 is a cross section along lines B-B of FIG. 5.
Figure 10:
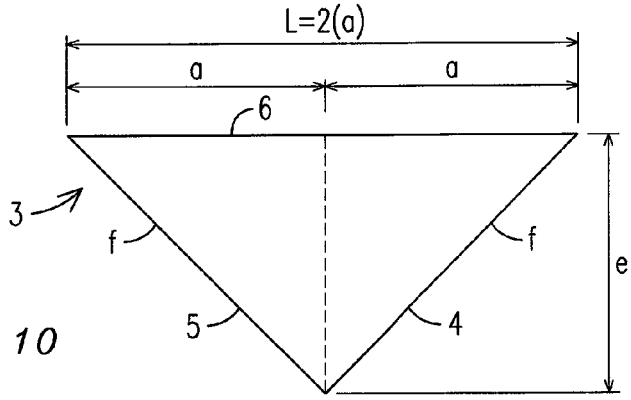
FIG. 10 is a top view of an upper panel of the present invention.
Figure 11:
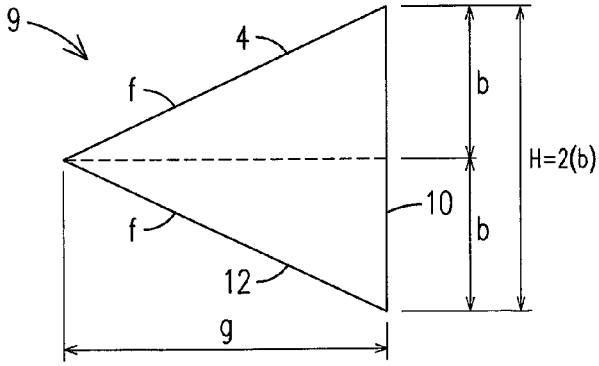
FIG. 11 is a front view of a front panel of the present invention.

For purposes of describing the preferred embodiment, the terminology used in reference to the numbered components in the drawings is as follows:

1. skylight window dormer, generally
2. pitched host roof
3. upper panel
4. front edge of upper panel
5. rear edge of upper panel
6. upper edge of upper panel
7. roof window
8. upper central axis
9. front panel
10. front edge of front panel
11. upper edge of front panel
12. lower edge of front panel
13. vertical window
14. front central axis
15. sill
16. cover
17. flashing
18. host roof/wall/framing
19. shim
20. connector
21. flange
22. cut line
23. spline
24. connector plate
25. clamp With reference to FIG. 1-11, the skylight window dormer 1 comprises two upper panels 3 having substantially identical triangular shapes. Each upper panel 3 comprises a front edge 4, a rear edge 5 and an upper edge 6. Said two upper panels 3 are joined along said upper edges 6 to form a roof window 7 having an upper central axis 8. Said rear edges 5 of said two upper panels 3 have a slope that is substantially equal to a slope of the pitched host roof 2 when the skylight window dormer 1 is installed on the pitched host roof 2 and the rear edges 5 of said two upper panels 3 are joined to the pitched host roof 2. Two front panels 9, having substantially identical triangular shapes, each comprise a front edge 10, an upper edge 11 and a lower edge 12. Said two front panels 9 are joined along said front edges 10 to form a vertical window 13 having a front central axis 14. Said lower edges 12 of said two front panels 9 have a slope that is substantially equal to the slope of the pitched host roof 2 when the skylight window dormer 1 is installed on the pitched host roof 2 and the lower edges 12 of said two front panels 9 are joined to the pitched host roof 2. Said upper edges 11 of said two front panels 9 are joined to said front edges 4 of said two upper panels 3 to form a substantially trapezoidal-shaped skylight window dormer 1 with said central axis 8 and front axis 14 meeting to form a substantially ninety degree angle.

Upper panels of the skylight window dormer are identical isosceles triangles joined at a base and inverted to form two upper surfaces at a horizontal ridge line located along a center line of the skylight window dormer. The upper panels are sloped to match an angle of a host roof angle ($\alpha$) or some other roof angle ($\beta$), preferably between 26 degrees and 45 degrees. The horizontal ridge line extends from the host roof to the upper vertical corner of the skylight window creating length (L) of the skylight window dormer.

Front panels 9 are also identical isosceles triangles joined at their base and rotated 90 degrees to form a vertical window and a vertical corner at a front edge of the skylight window dormer that runs where the two front panels abut against each other. The front panels intersect at an angle ($2\gamma$) which is a function of the width (W) and length (L) of the skylight window dormer. The front panels extend from the host roof to a corner line of the skylight window dormer where upper edges of the front panels abut front edges of the upper panels, thereby creating the height (H) of the skylight window dormer window.

The width of the skylight window dormer (W) is a function of the upper panel roof angle ($\beta$) in relation to the height (H) of the skylight window dormer. Either height (H) OR length (L) of the skylight window dormer is selected to suit the desired size and the remaining parameter is determined by the host roof slope (s)=H/L.

Horizontal roof ridge line and vertical window corner line of the skylight window dormer are orthogonal. Roof assembly and window assembly of the skylight window dormer intersect in a plane sloped ($\alpha$) degrees from horizontal.

The equal sides of all isosceles triangles are the same dimension (f). Fully assembled, the four panels of the skylight window dormer intersect such that all lower edges of the panels are all in the same plane which is integrated into the plane or pitch of the host roof by a base assembly.

The form of the skylight window dormer is an oblique tetrahedron with a rhombus or diamond shaped base.

The following are formulas and an examples for constructing and installing a skylight window dormer of the present invention on a pitched roof or other sloped surface.

| | |
|---|---|
| a = select to suit | $\tan\alpha$ = host roof slope |
| $b = a \tan\alpha$ | $\tan\beta = b/d$ |
| $c = a(1 + \tan^2\alpha)^{1/2}$ | $\tan\delta = d/c$ |
| d = select to suit | $\sin\delta = d/f$ |
| $e = d(1 + \tan^2\beta)^{1/2}$ | $\tan\gamma = d/a$ |
| $f = (c^2 + d^2)^{1/2}$ | $\tan\rho = \tan\alpha/\sin\delta$ |
| $g = a(1 + \tan^2\gamma)^{1/2}$ | $\tan\phi = 1/(\tan\alpha \sin\delta)$ |
| Host Roof Slope = rise/run | $\tan\lambda_1 = 1/\tan\phi = \tan\alpha \sin\delta$ |
| | $\tan\lambda_2 = 1/\tan\rho = \sin\delta/\tan\alpha$ |

EXAMPLE 1

| | | |
|---|---|---|
| a = 6.00 | $\tan\alpha = .5833$ | $\alpha = 30.24$ |
| $b = 6.00 \times .5833 = 3.50$ | $\tan\beta = 3.50/6.00 = .5833$ | $\beta = 30.24$ |
| $c = 6.00(1 + .5833^2)^{1/2} = 6.95$ | $\tan\delta = 6.00/6.95 = .8633$ | $\delta = 40.80$ |
| d = 6.00 | $\sin\delta = 6.00/9.18 = .6536$ | $\delta = 40.80$ |
| $e = 6.00(1 + .5833^2)^{1/2} = 6.95$ | $\tan\gamma = 6.00/6.00 = 1.000$ | $\gamma = 45.00$ |
| $f = (48.30 + 36.00)^{1/2} = 9.18$ | $\tan\rho = .5833/.6536 = .8924$ | $\rho = 41.75$ |
| $g = 6.00(1 + 1.000^2)^{1/2} = 8.48$ | $\tan\phi = 1/(.5833)(.6536) = 2.623$ | $\phi = 69.13$ |

-continued

| | | |
|---|---|---|
| Host Roof Slope = 7:12 | $\tan\lambda_1 = .5833 \times .6536 = .3812$ | $\lambda_1 = 20.87$ |
| | $\tan\lambda_2 = .6536/.5833 = 1.1205$ | $\lambda_2 = 48.25$ |

EXAMPLE 2

| | | |
|---|---|---|
| a = 6.00 | $\tan\alpha = .5833$ | $\alpha = 30.24$ |
| $b = 6.00 \times .5833 = 3.50$ | $\tan\beta = 3.50/3.50 = 1.000$ | $\beta = 45.00$ |
| $c = 6.00(1 + .5833^2)^{1/2} = 6.95$ | $\tan\delta = 3.50/6.95 = .5036$ | $\delta = 26.73$ |
| d = 3.50 | $\sin\delta = 3.50/7.78 = .4499$ | $\delta = 26.73$ |
| $e = 3.50(1 + 1.000^2)^{1/2} = 4.95$ | $\tan\gamma = .5833$ | $\gamma = 30.24$ |
| $f = (48.30 + 12.25)^{1/2} = 7.78$ | $\tan\rho = .5833/.4499 = 1.2965$ | $\rho = 52.36$ |
| $g = 6.00(1 + .5835^2)^{1/2} = 6.95$ | $\tan\phi = 1/(.5833)(.4499) = 3.811$ | $\phi = 75.30$ |
| Host Roof Slope = 7:12 | $\tan\lambda_1 = .5833 \times .4499 = .2624$ | $\lambda_1 = 14.70$ |
| | $\tan\lambda_2 = .4499/.5833 = .7713$ | $\lambda_2 = 37.64$ |

EXAMPLE 3

| | | |
|---|---|---|
| a = 5.00 | $\tan\alpha = .5833$ | $\alpha = 30.24$ |
| $b = 5.00 \times .5833 = 2.92$ | $\tan\beta = 2.92/4.00 = .7300$ | $\beta = 36.13$ |
| $c = 5.00(1 + .5833^2)^{1/2} = 5.79$ | $\tan\delta = 4.00/5.79 = .6908$ | $\delta = 34.64$ |
| d = 4.00 | $\sin\delta = 4.00/7.04 = .5682$ | $\delta = 34.64$ |
| $e = 4.00(1 + .7292^2)^{1/2} = 4.95$ | $\tan\gamma = 4.00/5.00 = .8000$ | $\gamma = 38.66$ |
| $f = (33.52 + 16.00)^{1/2} = 7.04$ | $\tan\rho = .5833/.5682 = 1.0266$ | $\rho = 45.75$ |
| $g = 5.00(1 + .8000^2)^{1/2} = 6.41$ | $\tan\phi = 1/.5833 \times .5682 = 3.017$ | $\phi = 71.66$ |
| Host Roof Slope = 7:12 | $\tan\lambda_1 = .5833 \times .5682 = .3314$ | $\lambda_1 = 18.34$ |
| | $\tan\lambda_2 = .5682/.5833 = .9741$ | $\lambda_2 = 44.25$ |

Figure 13:
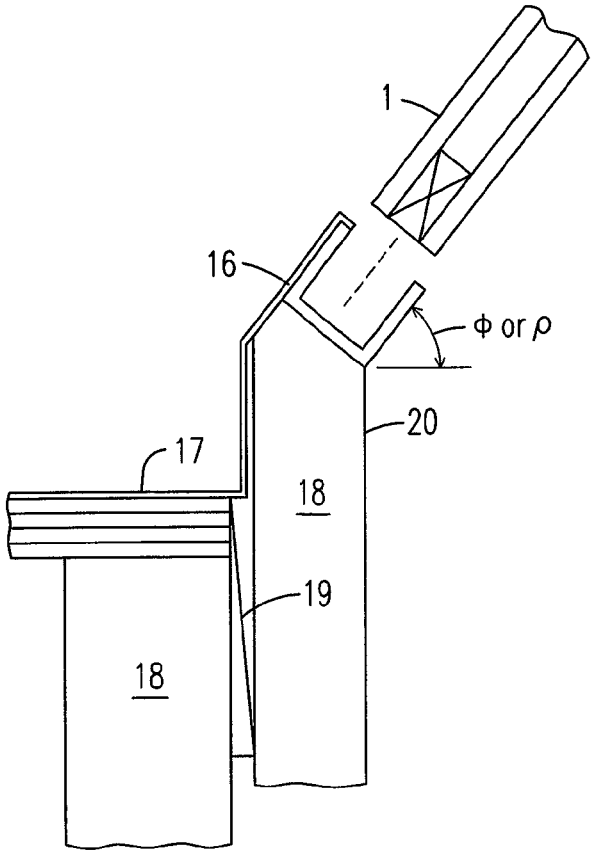
FIG. 13 is a detail view of a typical panel to host roof assembly.
Figure 14:
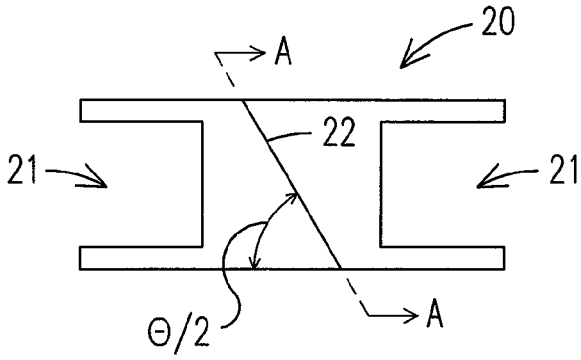
FIG. 14 is a detail view of a typical panel to panel connector.
Figure 15:
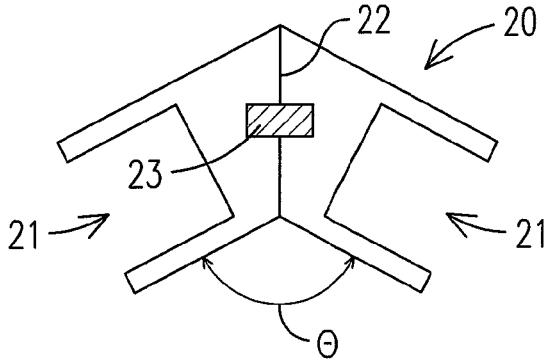
FIG. 15 is a detail view of a typical panel to panel connector cut along line A-A of FIG. 14 and inverted to form an angled connector.
Figure 16:
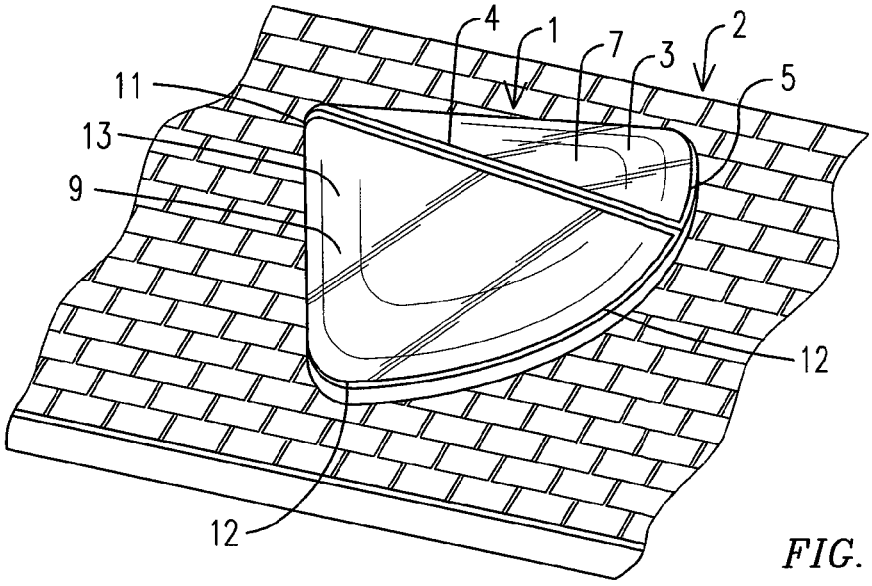
FIG. 16 is an elliptical skylight window dormer installed on a pitched host roof having an angled slope.
Figure 17:
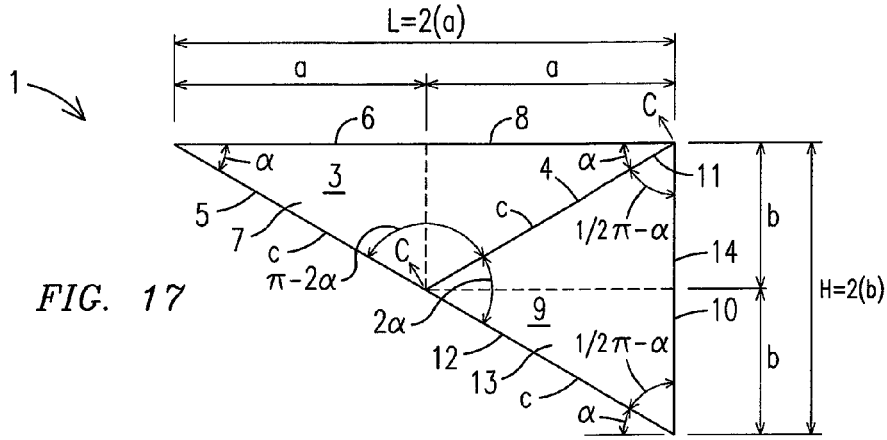
FIG. 17 is a side view of a skylight window dormer of the present invention.
Figure 18:
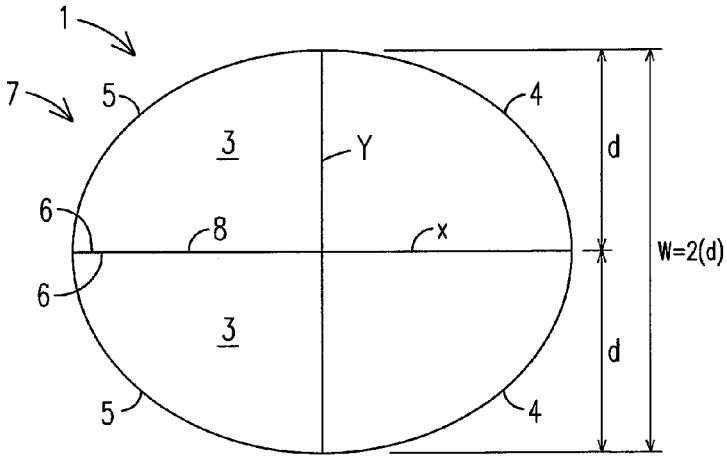
FIG. 18 is a top view of a skylight window dormer of the present invention.
Figure 19:
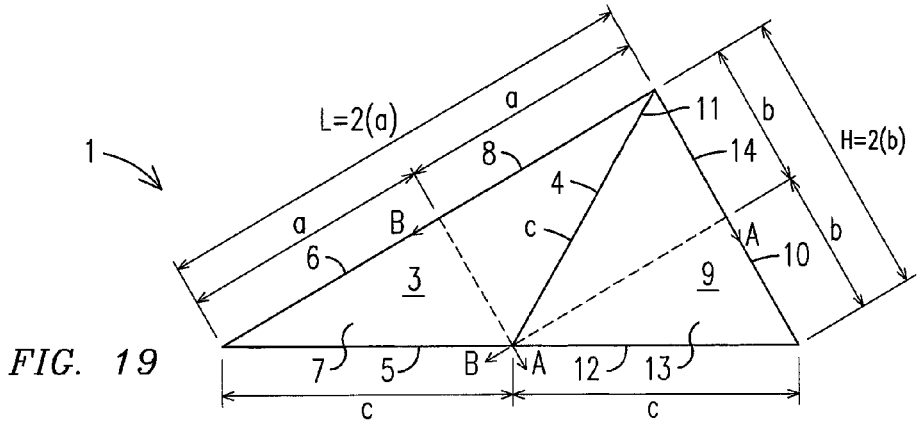
FIG. 19 is an opposing side view to FIG. 17 of a skylight window dormer of the present invention.
Figure 20:
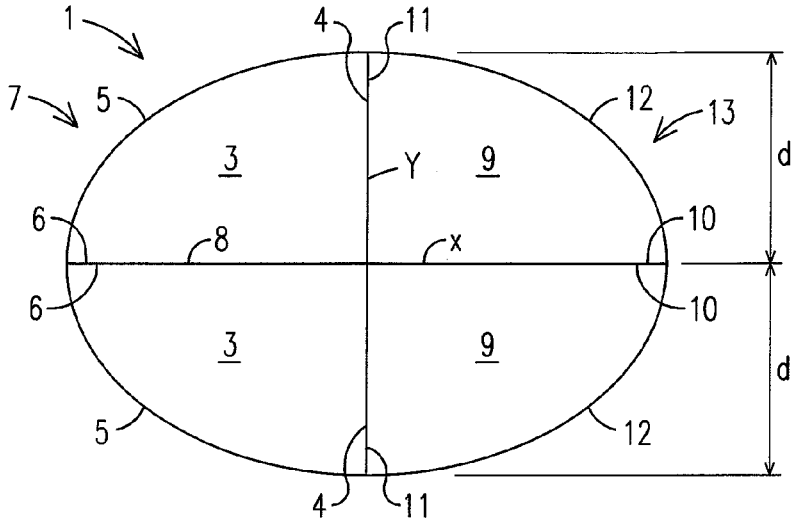
FIG. 20 is a perspective top view of a skylight window dormer of the present invention.
Figure 21:
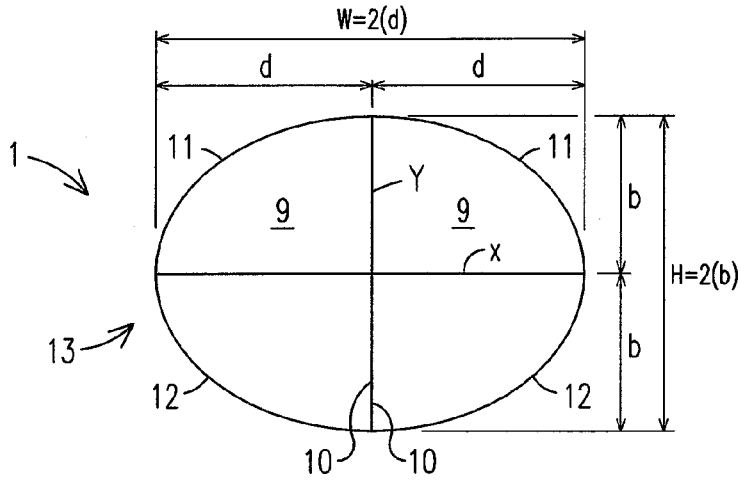
FIG. 21 is front view of a skylight window dormer of the present invention.
Figure 22:
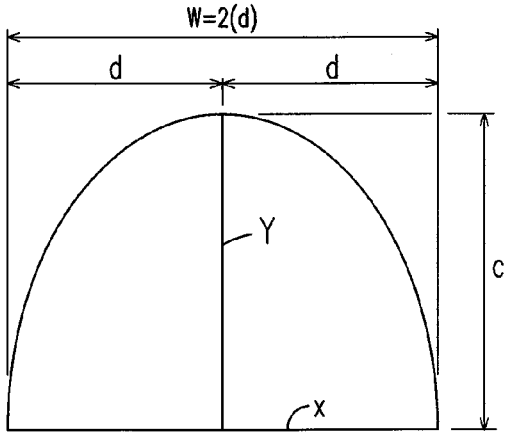
FIG. 22 is a cross section along lines C-C of FIG. 17.

Components or preferably insulated glass panels or equivalent plastic panels configured to suit the particular geometry discussed above with all edges protected and sealed by channels which are then bonded to the panels. All connectors, as illustrated in FIGS. 13-15, may be custom configured and fabricated to attach panels to one another with a weather tight seal and trim. Four sills interconnect to form a base which is slightly smaller than a rough opening cut into a host roof to install the skylight window dormer. The rough opening is created by cutting roof rafters in the host roof and reframing to accommodate particular geometry of the skylight window dormer base. Interior angles of the rough opening depend on the geometry of the skylight window dormer base. Panels attached to the top of the base and the base itself may be secured to the framing of the host roof by conventional means. Then, flashing, shingles, trim and so forth are installed around the skylight window dormer to complete installation.

Figure 12:
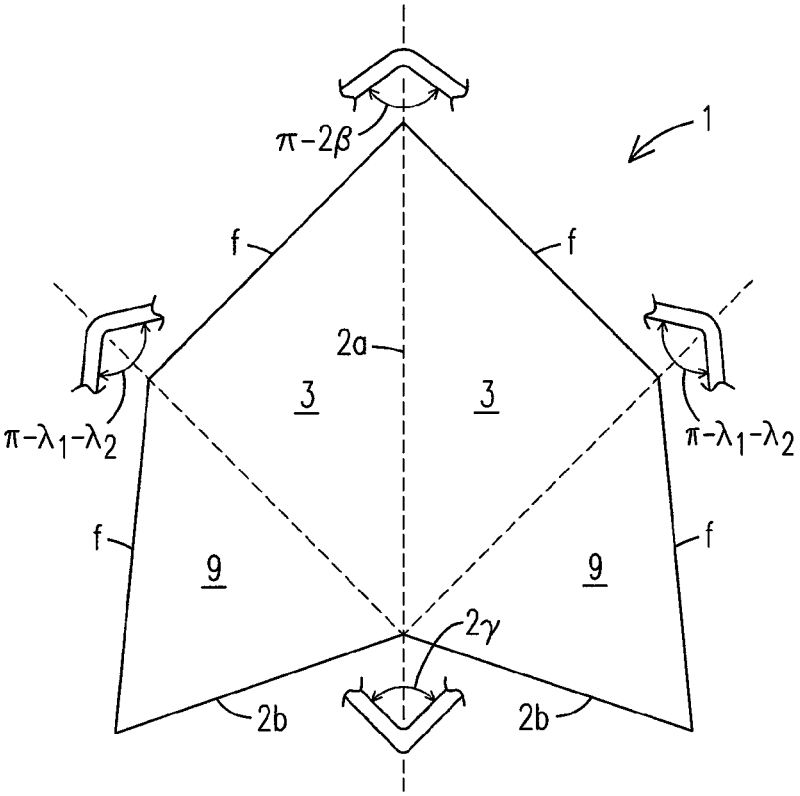
FIG. 12 is a plan for developing the present invention from a flat plastic sheet showing the angles required to create a monolithic three dimensional assembly from the flat plastic sheet material.

The skylight may be framed panels or a single monolithic piece formed or molded out of single piece of material and or have one or more edges fused or bonded together. For example, FIG. 12 illustrates a plan for developing the present invention from a flat plastic sheet showing the angles required to create a monolithic three dimensional assembly from the flat plastic sheet material.

With reference to FIG. 16-24, an elliptical skylight window dormer 1 installed on a pitched host roof 2 having an angled slope is illustrated. The skylight window dormer 1 comprises an upper panel 3 having a substantially elliptically-curved shape. Said upper panel 3 comprises a front edge 4 and a rear edge 5. Said upper panel forms a roof window. Said rear edge 5 of said upper panel 3 has a slope that is substantially equal to a slope of the pitched host roof 2 when the skylight window dormer 1 is installed on the pitched host roof 2 and the rear edge 5 of said upper panel 3 is joined to the pitched host roof 2. A front panel 9, having a substantially elliptically-curved shape comprises an upper edge 11 and a lower edge 12. Said lower edge 12 of said front panel 9 has a slope that is substantially equal to the slope of the pitched host roof 2 when the skylight window dormer 1 is installed on the pitched host roof 2 and the lower edge 12 of said front panel 9 is joined to the pitched host roof 2. Said upper edge 11 of said front panel 9 is joined to said front edge 4 of said upper panel 3 to form a substantially elliptically-curved skylight window dormer 1 with said front panel 9 and upper panel 3 meeting to form a substantially ninety degree angle.

Both the upper panel and front panel are created from glass or plastic sheets which are laid out geometrically so that they can be developed into elliptically curved panels about a first principal axis and symmetrically mitered panels about a second principal axis. All free edges and the common edges are identically shaped half ellipses.

The lower/free edge of the skylight window dormer is secured to an elliptically shaped curb or sill which is custom made to match the elliptically shaped bottom edge of the skylight window dormer. However, before the skylight window dormer is attached to this curb or sill, the curb or sill itself has to be integrated into a rectangular framed roof panel which in turn can be easily and conventionally integrated into a framed roof or wall structure.

The length L=(2a) or height H=(2b) of skylight window dormer is selected to suit. The remaining parameter is determined by host roof or wall slope ($\alpha$). The width W=(2d) of the skylight window dormer is selected to suit. The length of skylight window dormer base $2c=2(a^2+b^2)^{1/2}$.

The skylight panel is formed with an elliptical cross section at its midpoint. The equation for this ellipse is: $(x/d)^2+(y/b)^2=1$. The perimeter of the panel at its midpoint cross section is $So=\pi[(d^2+b^2)/2]^{1/2}$ The width of panel is (2a). Edges of the skylight panel are mitered at angle ($\alpha$).

The window panel is formed with an elliptical cross section at its midpoint. The equation for this ellipse is: $(x/d)^2+(y/a)^2=1$. The perimeter of the panel at its midpoint cross section is $So=\pi[(d^2+a^2)/2]^{1/2}$. The width of panel is (2b). Edges of the window panel are mitered at angle ($\pi/2-\alpha$).

The shape of the common edge of both skylight and window panels and the shape of the cutout of the host roof or wall is defined by the following equation: $(x/c)^2+(y/d)^2=1$.

The skylight panel intersects the host roof or wall at angle ($\alpha$) and window panel intersects same at angle ($\pi/2-\alpha$). The centerline of skylight panel intersects the centerline of window panel at a right angle ($\pi/2$).

The following are formulas and an example for constructing and installing a skylight window dormer of the present invention on a pitched roof or other sloped surface.

| | |
|---|---|
| a ≡ host roof or wall angle (given) | $\alpha$ = 30.24 degrees |
| tan $\alpha$ = a/b = host roof or wall slope (given) | tan $\alpha$ = a/b = 7/12 = .5833 |
| a ≡ half length of SWD (select to suit) | a = 5.00 |
| b ≡ half height of SWD = a tan $\alpha$ | b = 2.92 |
| c ≡ half length of SWD base = $(a^2 + b^2)^{1/2}$ = $a(1 + \tan^2\alpha)^{1/2}$ | c = 5.79 |
| d = half width of SWD (select to suit) | d = 4.00 |
| skylight ellipse: $(x/d)^2 + (y/b)^2 = 1$ | $(x/4.00)^2 + (y/2.92)^2 = 1$ |
| window ellipse: $(x/d)^2 + (y/a)^2 = 1$ | $(x/4.00)^2 + (y/5.00)^2 = 1$ |
| base/connector ellipse: $(x/d)^2 + (y/c)^2 = 1$ | $(x/4.00)^2 + (y/5.79)^2 = 1$ |
| perimeter of skylight panel @ midpoint: so = $\pi[(d^2 + b^2)/2]^{1/2}$ | so = $3.14(16.53/2)^{1/2}$ = 11.06 |
| perimeter of window panel @ midpoint: so = $\pi[(d^2 + a^2)/2]^{1/2}$ | so = $3.14(41.00/2)^{1/2}$ = 14.23 |

Figure 27:
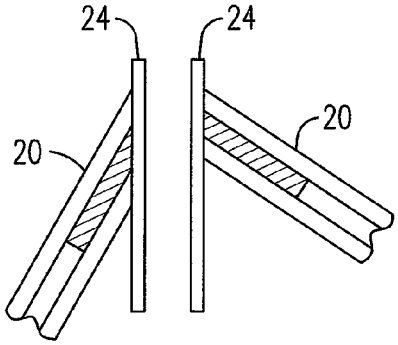
FIG. 27 is an exploded detail view of connector plates for connecting panels during pre unit assembly.

Two elliptically shaped aluminum "horse shoes" which are fastened, sealed and bonded to the skylight and window panels respectively where they meet before these panels are assembled, as illustrated in FIG. 27.

Figure 29:
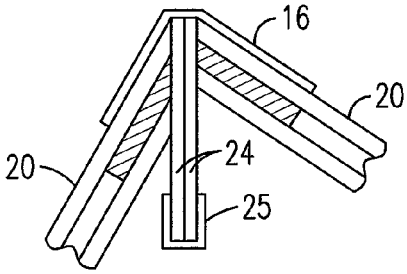
FIG. 29 is a detail view of connector plates for connecting panels clamped together and covered during post unit assembly.
Figure 30:
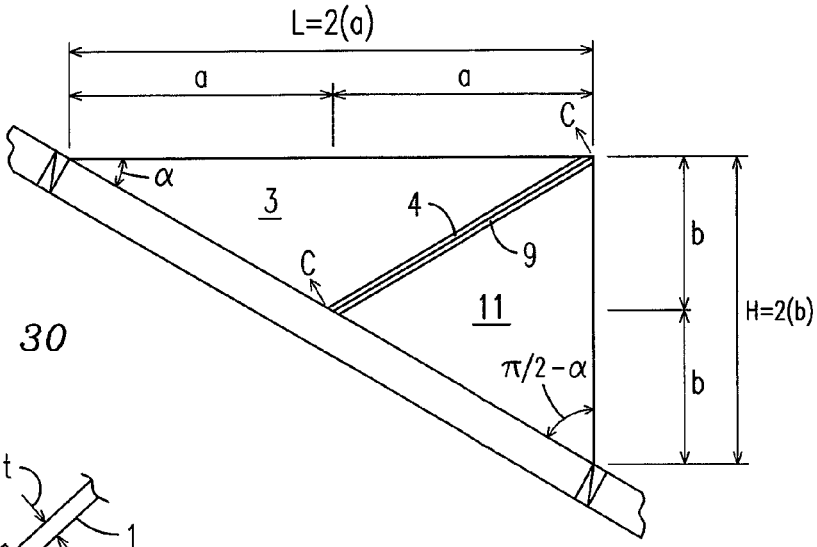
FIG. 30 is a side view of a skylight window dormer installed on a pitched host roof having an angled slope.

One aluminum cover attached over the connection between the skylight and window panels. Cover is scored in the middle and then bent from 0radians at the base to $\pi/2$ radians at the top to conform to the geometry of the intersecting skylight and window panels, as illustrated in FIG. 29.

Figure 28:
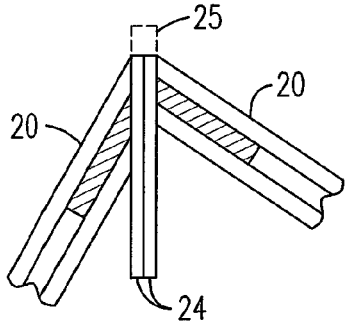
FIG. 28 is a detail view of connector plates for connecting panels clamped together during unit assembly.

One continuous aluminum clip attached to the inside "flange" of the skylight window dormer connector plates which runs an elliptical course from the base on one side of the skylight window dormer to the base on the other side of the skylight window dormer, as illustrated in FIG. 28.

Figure 31:
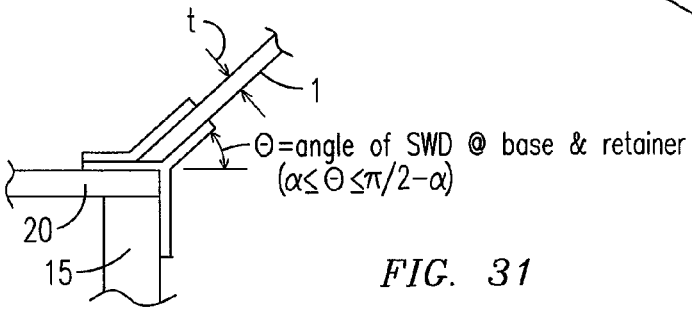
FIG. 31 is a detail view of a typical panel to host roof assembly.
Figure 33:
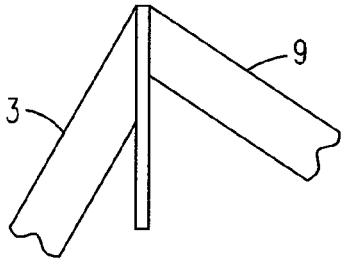
FIG. 33 is a cross section along lines D-D of FIG. 32.
Figure 34:
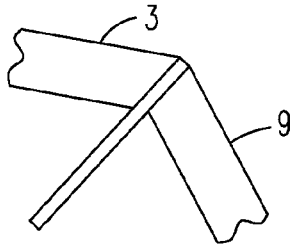
FIG. 34 is a cross section along lines E-E of FIG. 32.
Figure 35:
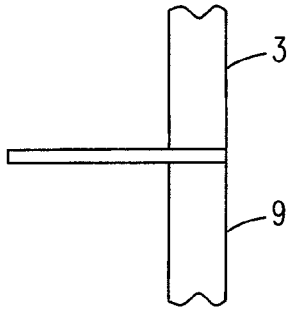
FIG. 35 is a cross section along lines F-F of FIG. 32.
Figure 32:
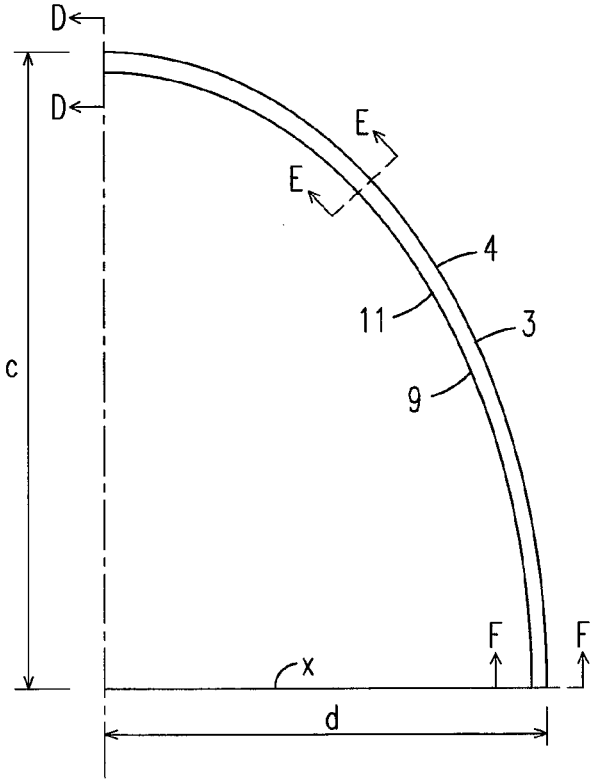
FIG. 32 is a cross section along lines C-C of FIG. 30.

Four T shaped aluminum extrusions which are formed to create the base of the skylight window dormer. Primary Forming of these extrusions creates the ellipse per the equation for the cutout in the host roof or wall. Secondary forming creates the proper flange angle required to receive mating edge of skylight window dormer, as illustrated in FIG. 31.

Four L shaped aluminum extrusions which are formed to create the retainer of the skylight window dormer. Primary forming of these extrusions creates the ellipse per the equation for the cutout in the in the host roof or wall. Secondary forming creates the proper flange angle required to retain the exterior surface of the skylight window dormer in place, as illustrated in FIG. 31.

Two insulated glass or equivalent plastic panels configured to suit a particular geometry with edges mitered to match squarely with each other and with the host roof or wall as illustrated in FIG. 31-35.

Four triangular aluminum plates at the vertex of the skylight and window panels where they meet at the base of the skylight window dormer. These plates reinforce the connection between the skylight/window panels and the elliptically shaped extrusions at the midpoint of skylight window dormer base where all components are perpendicular to the host roof or wall.

One elliptically shaped wood sill or curb laminated or otherwise formed to suit the geometry of a particular skylight window dormer and the framing depth of the host roof or wall.

Host roof or wall is framed conventionally to accommodate the rectangular roof panel with the ellipsoid skylight window dormer completely installed therein. Secondary framing, sheathing and weather stripping to adapt the elliptically shaped sill or curb and ellipsoid skylight window dormer to conventional rectangular framing in the host roof or wall structure. Roofing shingles and trim to retrofit or complete the installation.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A skylight window dormer for installation on a pitched host roof having an angled slope, said skylight window dormer comprising:

two upper panels having substantially identical triangular shapes each having a front edge, a rear edge and an upper edge;

said two upper panels being joined along said upper edges to form a roof window having an upper central axis;

said rear edges of said two upper panels having a slope that is substantially equal to the slope of a pitched host roof when the skylight window dormer is installed on the pitched host roof and the rear edges of said two upper panels are joined to the pitched host roof;

two front panels having substantially identical triangular shapes each having a front edge, an upper edge and a lower edge;

said two front panels being joined along said front edges to form a vertical window having a front central axis; and said lower edges of said two front panels having a slope that is substantially equal to the slope of the pitched host roof when the skylight window dormer is installed on the pitched host roof and the lower edges of said two front panels are joined to the pitched host roof; and said upper edges of said two front panels being joined to said front edges of said two upper panels to form a substantially trapezoidal-shaped skylight window dormer.

2. The skylight window dormer of claim 1 wherein:

said central axis and front axis meet to form a substantially ninety degree angle.

3. The skylight window dormer of claim 1 wherein:

a substantially diamond-shaped base of the skylight window dormer created by the rear edges of said two upper panels and said lower edges of said two front panels.

4. The skylight window dormer of claim 1 wherein:

a substantially rhombus-shaped base of the skylight window dormer created by the rear edges of said two upper panels and said lower edges of said two front panels.

5. The skylight window dormer of claim 1 wherein:

said two upper panels are substantially identical isosceles triangles; and said two front panels are substantially identical isosceles triangles.

6. The skylight window dormer of claim 1 wherein:

said two upper panels are transparent.

7. The skylight window dormer of claim 1 wherein:

said two front panels are transparent.

8. The skylight window dormer of claim 1 wherein:

said two upper panels are translucent.

9. The skylight window dormer of claim 1 wherein:

said two front panels are translucent.

10. A skylight window dormer for installation on a pitched host roof having an angled slope, said skylight window dormer comprising:

an upper panel having a substantially elliptically-curved shape, a front edge and a rear edge;

said rear edge of said upper panel having a slope that is substantially equal to the slope of a pitched host roof when the skylight window dormer is installed on the pitched host roof and the rear edge of said upper panel is joined to the pitched host roof;

a front panel having a substantially identical elliptically-curved shape, an upper edge and a lower edge; and said lower edge of said front panel having a slope that is substantially equal to the slope of the pitched host roof when the skylight window dormer is installed on the pitched host roof and the lower edge of said front panel is joined to the pitched host roof; and said upper edge of said front panel being joined to said front edge of said upper panel to form a substantially elliptically-curved skylight window dormer.

11. The skylight window dormer of claim 10 wherein:

said upper edge of said front panel being joined to said front edge of said upper panel to form a substantially ninety degree angle.

12. The skylight window dormer of claim 10 wherein:

said rear edge of said upper panel and said lower edge of said front panel each being substantially identically shaped half ellipses.

13. The skylight window dormer of claim 10 wherein:

a substantially ellipse-shaped base of the skylight window dormer created by the rear edge of said upper panel and said lower edge of said front panel.

14. The skylight window dormer of claim 10 wherein:

a substantially oval-shaped base of the skylight window dormer created by the rear edge of said upper panel and said lower edge of said front panel.

15. The skylight window dormer of claim 12 wherein:

a substantially ellipse-shaped base of the skylight window dormer created by the rear edge of said upper panel and said lower edge of said front panel.

16. The skylight window dormer of claim 12 wherein:

a substantially oval-shaped base of the skylight window dormer created by the rear edge of said upper panel and said lower edge of said front panel.

17. The skylight window dormer of claim 10 wherein:

said upper panel is transparent.

18. The skylight window dormer of claim 10 wherein:

said front panel is transparent.

19. The skylight window dormer of claim 10 wherein:

said upper panel is translucent.

20. The skylight window dormer of claim 10 wherein:

said front panel is translucent.

* * * * *